United States Patent [19]

Campolo

[11] Patent Number: 4,694,223

[45] Date of Patent: Sep. 15, 1987

[54] THERMAL SENSOR FOR A LIGHTING FIXTURE

[75] Inventor: Steve Campolo, Valley Stream, N.Y.

[73] Assignee: Leviton Manufacturing Company, Inc., Little Neck, N.Y.

[21] Appl. No.: 846,394

[22] Filed: Mar. 31, 1986

[51] Int. Cl.[4] ..... H01J 7/24

[52] U.S. Cl. ..... 315/118; 315/177; 315/309; 337/22; 362/276

[58] Field of Search ..... 315/117, 118, 309; 361/105; 337/22, 123; 362/276

[56] References Cited

U.S. PATENT DOCUMENTS

| | | | |
|---|---|---|---|
| 1,767,582 | 6/1930 | Fisher | 315/309 |
| 1,830,578 | 11/1931 | Vaughan | 361/105 |
| 2,089,896 | 8/1937 | Journeaux | 315/117 |
| 2,159,537 | 5/1939 | Stevens | 315/118 |
| 2,760,117 | 8/1956 | VanRyan | 361/105 |
| 4,400,673 | 8/1983 | Gilman | 315/309 |

*Primary Examiner*—Harold Dixon
*Attorney, Agent, or Firm*—Paul J. Sutton

[57] ABSTRACT

A heat flow detector for protecting against overheating of a lamp fixture energized from a voltage source, even when a dimmer is used for operating the lamp fixture. The detector includes a temperature sensitive switch electrically coupled to the lamp fixture. The switch disconnects the lamp fixture from the voltage source in response to a predetermined temperature. A biasing heater is thermally coupled to the temperature sensitive switch for raising the temperature of the switch sufficiently to operate the switch upon overheating of the lamp. A regulating circuit maintains the required voltage across the heater even upon reduction of the voltage from the source through use of the dimmer. The heat flow detector is placed in the vicinity of the lamp fixture so as to be subject to the same heat flow environmental conditions as the lamp fixture whereby as the lamp fixture gets overheated, the resistor heated up will be sufficient to operate the switch.

16 Claims, 4 Drawing Figures

THERMAL SENSOR FOR A LIGHTING FIXTURE

BACKGROUND OF THE INVENTION

This invention relates to a thermal sensor for detecting the overheating of lighting fixtures, and more particularly to a heat flow detector for use in conjunction with a recessed incandescent fixture in which a dimmer is provided to control the intensity of the light.

Lighting fixtures are subject to overheating and produce dangerous conditions to the surrounding structure. This is especially a problem with recessed fixtures placed above a ceiling where there is often inadequate ventilation. The space above the ceiling is generally filled with thermal insulation which limits the flow of air in to the space surrounding the lighting fixture. Installing barriers around the recessed fixtures is prohibitively expensive and difficult to achieve. While in new building structures some possibilities exist for spacing the insulation from the recessed fixtures to provide for dissipation of the heat in the surrounding area, in existing homes and buildings this may not always be possible. As a result, the heat generated within the fixture cannot sufficiently dissipate and overheating of the lamp occurs.

Overheating of the lamp can also occur as a result of overlamping, whereby a lamp of greater wattage then the fixture is rated for, is utilized within the lamp. With the larger wattage lamp, the heat generated by the lamp is not dissipated quickly enough and the fixture temperature becomes higher than intended by the fixture designer.

Overheating of the lamp either due to overlamping or inadequate spacing from the thermal insulation can result in damage to the lamp and its parts. Generally, a particular fixture is designed of plastic parts and wire insulation which is adequate for use with predesigned rating of heat. Overheating of the lamp results in damage to the fixture. Even worse, eventual deterioration of the fixture components may actually result in fire. Such fires from overheated fixtures have caused millions of dollars of property damage.

The use of thermal protectors for various types of circuits have previously been known. In most cases, thermal protectors have been utilized for motor circuits. By way of example, U.S. Pat. No. 3,141,996 describes a thermal protector which is placed in heat exchange relationship with a motor so that overheating of the motor will actuate the thermal switch and disconnect the motor from operation. Similarly, U.S. Pat. No. 4,136,323 describes an overload circuit for a motor winding, whereby the overload circuit is in direct contact with the windings such that occurrence of an over-temperature condition in the windings actuates the protector circuit. Thermal protectors have also been used with lighting fixtures such as described in U.S. Pat. No. 4,131,868. In this invention, the socket of the incandescent lamp includes a thermal protector in direct contact with the socket, whereupon overheating of the socket causes activation of the thermal protector. Likewise, U.S. Pat. No. 4,388,677 describes a housing for a lamp which includes a built in thermal protector.

While these devices are useful for the electrical equipment for which they are designed, it is not always possible to build in the thermal detector directly as part of the electrical apparatus as in these inventions. Accordingly, co-pending Ser. No. 433,579, assigned to the assignee of the present invention, describes a heat flow detector which is not part of the lighting fixture itself. The heat flow detector is placed in a junction box which is located to the lighting fixture. The heat flow detector responds to the same environment of the fixture in which the lighting fixture is located. Accordingly, any restriction of the flow of heat in the environment of the fixture also restricts the flow of heat from the junction box. The heat flow detector includes a thermal switch which is serially connected with the lighting fixture to disconnect the lighting fixture from the source of energy upon actuation of the switch. A heating element is thermally in contact with the switch. The heating element is designed to provide heat above that of the surrounding environment.

When the lamp overheats, the heat within the environment of the lamp increases. Dissipation of the heat is restricted by the thermal insulation surrounding the lamp. Since the junction box is within the same environment as the lamp, the temperature in the surrounding environment adjacent the junction box also increases. The heating element is designed so that its heat in excess of the temperature of the surrounding environment produced by an overheated lamp will be sufficient to actuate the switch. The switch will then disconnect the lamp fixture.

While such heat flow detector for a recessed incandescent fixture is useful, various electrical codes require that the thermally protected incandescent lighting fixture also operate when a dimmer is utilized to control the fixture. In the aforementioned co-pending application, the heating element is energized by the voltage from the same source feeding the fixture. With the presence of a dimmer, the voltage across the lighting fixture can be lowered. Similarly, the voltage across the heating element will be reduced and possibly below the required operating voltage. The voltage will therefore not be sufficient for the heating element to reach its operating temperature. As a result, with the presence of a dimmer, the aforementioned heat flow detector may not provide adequate biasing heating to oeprate the thermal switch.

SUMMARY OF THE INVENTION

The present invention provides an improvement over the heat flow detector of the aforementioned co-pending application. It includes a regulating circuit responsive to the input across voltage across the lighting fixture. However, the regulation circuit is designed to provide a constant output voltage which feeds the heating element, regardless of the input voltage. As a result, the heating element sees a constant voltage even in the presence of a dimmer circuit controlling the operation of the lighting fixture. The heat from the heating element will therefore remain constant even in the presence of a dimmer. The heater will serve to raise the temperature sufficiently above an overheated lamp condition to operate the thermal activated switch thereby disconnecting the overheated lighting fixture from the source of energy.

Accordingly, an object of the present invention is to provide a heat flow detector for use with recessed incandescent fixtures which are under control of a dimmer circuit.

Another object of the present invention is to provide a thermal insulation sensor for protecting a recessed incandescent lighting fixture even with a dimmer being utilized with the fixture.

Still a further object of the present invention is to provide a apparatus for protecting against overheating of a lamp fixture energized from a voltage source, in which a dimmer is present.

Yet a further object of the present invention is to provide a improved thermal insulation sensor for incandescent lighting fixtures.

Briefly, in accordance with the present invention, the apparatus for protecting the overheating of the lamp fixture includes a heat flow detector for attachment at a location in the vicinity of the lamp fixture to be subject to the same heat flow environmental conditions as the lamp fixture. The detector includes a temperature sensitive switch which is electrically coupled to the lamp fixture to disconnect the lamp fixture from the voltage source upon overheating of the lamp. A biasing heater is also energized from the voltage source. The biasing heater is thermally coupled to the temperature sensitive switch to raise the temperature of the switch sufficiently to activate the switch when overheating of the lamp prevents adequate dissipation into the environment of the heat from the biasing heater. A regulating circuit is connected between the voltage source and the biasing heater for maintaining a required voltage across the biasing heater even upon reduction of the voltage to the fixture from the source.

Reduction of the voltage to the fixture can occur when a dimmer is utilized to control the light from the fixture. The regulating circuit that includes a step down device for connection across the input voltage to the fixture. A rectifying circuit is coupled to the output of the step down device and a voltage regulator is coupled to the output of the rectifying circuit and feeds the biasing heater.

The aforesaid objects features and advantages of the invention will in part, be pointed with particularity, and will in part, be obvious from the following more detailed description of the invention, taken in conjunction with the accompanying drawing, which forms an integral part thereof.

BRIEF DESCRIPTION OF THE DRAWING

In the Figures

In the various figures of the drawing like reference characters designate like parts.

DESCRIPTION OF THE PREFERRED EMBODIMENT

Figure 1:
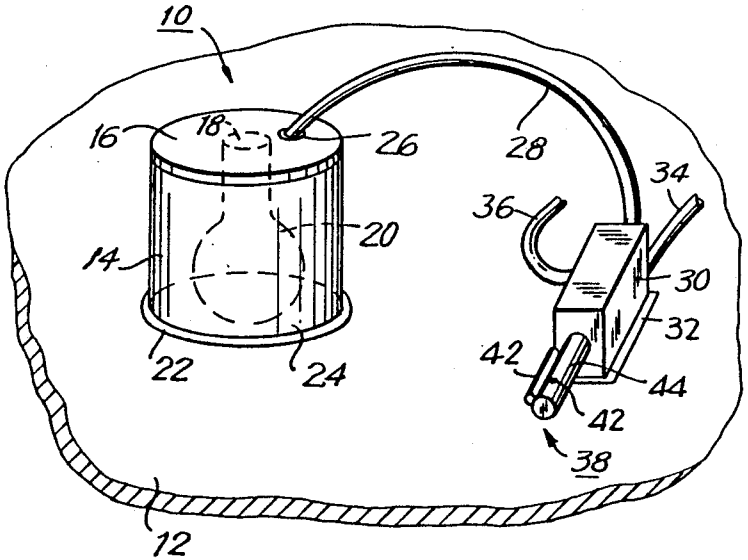
FIG. 1 illustrates the present invention operatively connected to a recessed lighting fixture.

Referring now to FIG. 1, there is illustrated use of the present invention within an area designated generally at 10. The environment includes a hung ceiling arrangement 12 wherein a hung ceiling supports a high hat or recessed fixture 14. Recessed fixture 14 is of a generally cylindrical shape including an upper cover 16 which supports a socket 18 into which an incandescent lamp 20 is inserted. A lower ring 22 supports the fixture 14 about an opening 24 in the hung ceiling 12 and provides a decorative trim at the bottom of the fixture. When lamp 20 is on, it illuminates the area beneath the hung ceiling 12.

Extending from the cover 16 of the fixture 14 is a first cable 28 connected at the electrical port 26. Cable 28 supplies the power to the lamp socket 18 for energizing the lamp 20. The other end of cable 28 is fed into a junction box 30 which is supported on a flange 32 placed on top of the hung ceiling 12.

A cable 34 brings the power to the junction box. Another cable 36 leaves the junction box and connects through a switch (not shown) to the other end of a voltage source. Typically, the switch is mounted in the area below the hung ceiling and usually at a convenient location adjacent an entry doorway into the room. The switch is frequently of a dimmer type to control the electrical voltage of the lamp 20 to thereby controlling the illumination output of the lamp.

Projecting from a front of the junction box 30 is a heat flow detector, shown generally at 38. The heat flow detector 38 includes a biasing heater 42 which is attached in thermal proximity to a detector housing 44 in which is located a temperature sensitive switch. The temperature sensitive switch is serially connected in the electrical wiring feeding the lamp.

The junction box 30 is placed close enough to the lamp fixture to be included within the same environmental conditions surrounding the lamp fixture. Typically, thermal insulation will be placed in the space around the lamp fixture. The thermal insulation should be adequately spaced from the lamp fixture, either with our without the presence of a barrier, to permit adequate dissipation of the heat from the lamp fixture. With such adequate dissipation, the heat within the environment surrounding the lamp fixture and surrounding the junction box will be below a preselected temperature level.

The biasing heater 42 is set to provide additional heat to the detector 44 above heat of the surrounding environment. So long as the lamp has adequate dissipation of its heat, the heat generated by the biasing heater will be insufficient to activate the thermally sensitive switch. However, when the lamp becomes overheated, the heat in the environmental area surrounding the lamp will be insufficiently dissipated. The temperature in the space surrounding the lamp and the junction box will increase. The biasing heater will now provide the additional heat above the higher surrounding temperature to sufficiently activate the temperature sensitive switch. The switch will then disconnect the lamp from the source of energy.

Under the present arrangement, disconnection of the lamp will permit the lamp to cool sufficiently so that the temperature sensitive switch will again close, thereby re-energizing the lamp. The lamp will continue the cyclical response providing a warning of the overheating of the lamp.

The overheating of the fixture can occur as a result of inadequate space due to presence of thermal insulation close to the fixture. Additionally, the overheating can occur as a result of overlamping, whereby a lamp is utilized whose wattage is greater than that for which the fixture is rated.

Figure 2:
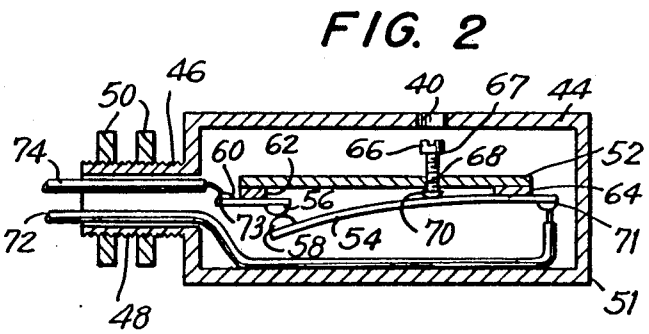
FIG. 2 is a cross-sectional view of the temperature sensitive switch in its enclosure.

FIG. 2 is a cross-section through the detector body 44 showing the temperature sensitive switch. Specifically, the detector body 44 is a housing having at one end a neck 46 with an external screw threaded surface 48 to facilitate connection to the junction box 30. To further facilitate such connection, the neck 46 is provided with a pair of lock nuts 50.

At the end remote from the neck 46 the detector body 44 includes a cap 51 which closes off the detector body housing. The top portion of the detector body 44 includes an adjustment opening 40. The opening 40 serves two functions. Firstly, it permits thermal flow from the adjacent heating element 42 to enter into the detector body 44 as well as the temperature of the surrounding environment to enter into the detector body 44. At the same time, it permits entry of an adjusting device, such as a screwdriver, to control the temperature setting at which the switch will response, as will hereinafter be described.

Within the detector body 44 is a bi-metallic switch frame 52. At one end of frame 52 is a first insulator 62 from which depends a support plate 60 having one end connected to a first contact 56. Switch frame 52 supports another insulator 64 from which depends a bi-metallic element 54. The other end of the bi-metallic element 54 is connected to a second contact 58 which normally engages the first contact 56. Approximately one third of the length along the switch frame 52 from the end where the insulator 64 is connected there is provided a threaded hole 68. An adjusting screw 66 is threaded into the hole 68. Adjusting screw 66 has a slot 67 approximate the adjustment opening 40 for receiving an adjusting tool. The other end of the adjusting screw 66 has an insulation 70 attached to its end. The end of the screw 67 through the insulation end 70 contacts the bi-metallic element 54. Adjustment of the screw 66 can control the temperature at which the bi-metallic element 54 will respond.

The end of the bi-metallic element 54 outward of the insulator 64 has a first wire opening 71 for receiving a first wire 72 from the junction box. The end of the support plate 60 outward of the insulator 62 has a wire opening 73 for receiving a second wire 74 from the junction box.

The bi-metallic element 54 is arcuate in shape. It will distort as the temperature increases. In this way, the moderate bow shape shown by the bi-metallic element 54 will become more pronounced with an increase in temperature. As the bow increases, the contact 58 will move from contact 56 thereby opening the electrical circuit between the wires 72 and 74.

Normally, the adjusting screw 66 is set such that the temperature provided by the biasing heater 42 will be insufficient to cause opening of the switch contacts 56, 58. However, should the temperature surrounding the junction box be increased as a result of overheating of the adjacent area by a overheating of the fixture, the temperature setting is set that the biasing heater will cause opening of the contacts 56, 58.

It should be appreciated, that although a bi-metallic sensor has been described, the temperature sensitive switch could be other similar devices such as a mercury column temperature sensor, and others.

Figure 3:
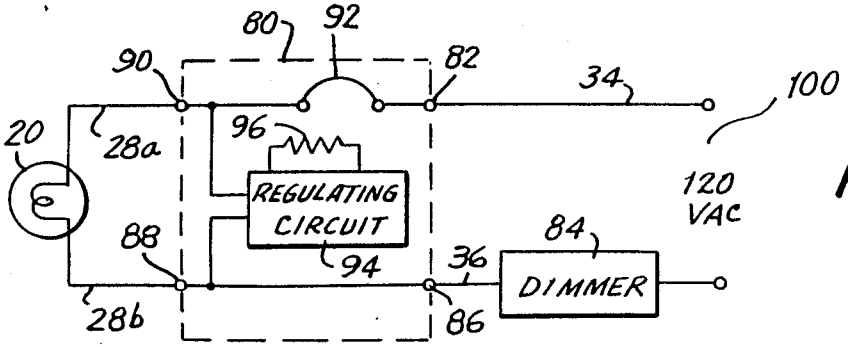
FIG. 3 is a schematic diagram of the circuit of the present invention.

With reference now to FIG. 3, there is shown a schematic of one form of the electrical connection of the present invention, together with the lamp that it serves. Within the dashed line of FIG. 3 is shown the heat flow detector and related circuitry 80 which would normally be contained within the junction box 30 and the detector body 44 shown in FIG. 1. The input wire 34 would be connected to a first terminal 82 at the circuit. The wire 36 is connected through a dimmer switch 84 to the other end of the voltage source. The wire 36 is connected to another input terminal 86 at the detector circuit 80. At the output of the detector circuit are provided the terminals 88, 90 from which the lead wires **28*a* and 28*b* lead to the lamp 20**.

Internally of the detector circuitry is provided the bi-metallic temperature sensitive switch shown generally at 92. Connected in parallel across the output which feeds the lamp 20 is a regulating circuit 94 which provides a constant voltage to the biasing heater, shown as resistor 96.

In operation, the voltage source 100 provides the energization for the lamp 20 through the dimmer switch 84. Operation of the dimmer switch would decrease the voltage across the lamp 20 to provide a limited amount of illumination, as desired. Since the heating resistance element 96 is connected across the lamp, the reduced voltage resulting upon operation of the dimmer switch would also result in a reduced voltage across the resistor 96. Such reduction would cause the resistor heating element 96 to fail to reach its operating temperature and thereby fail to provide adequate heat for operation of the bi-metallic temperature sensitive switch 92.

By means of the regulating circuit, a constant voltage output is supplied to the heating element 96 so as to maintain a constant voltage regardless of the input voltage. So long as the heating element 96 sees the constant voltage, its heat will remain constant and provide the necessary temperature for the switch 92.

When the lamp overheats, the temperature in the environment around the lamp, as well as the temperature in the environment around the junction box, increases. The heat from the resistor 96 will be adequate to raise the temperature of the bi-metallic switch sufficiently to cause the switch to open, thereby opening the line 34 feeding the lamp 20 so as to disconnect the lamp.

As the lamp 20 and the resistor 96 cool down, the temperature will decrease and the switch 92 will sense the decreased temperature and reconnect the lamp 20 to the voltage 100. If conditions at the lamp 20 have not improved, the switch 92 will again open. This cyclical opening and closing of the switch 92 will serve as a warning that the recessed fixture should be inspected.

Figure 4:
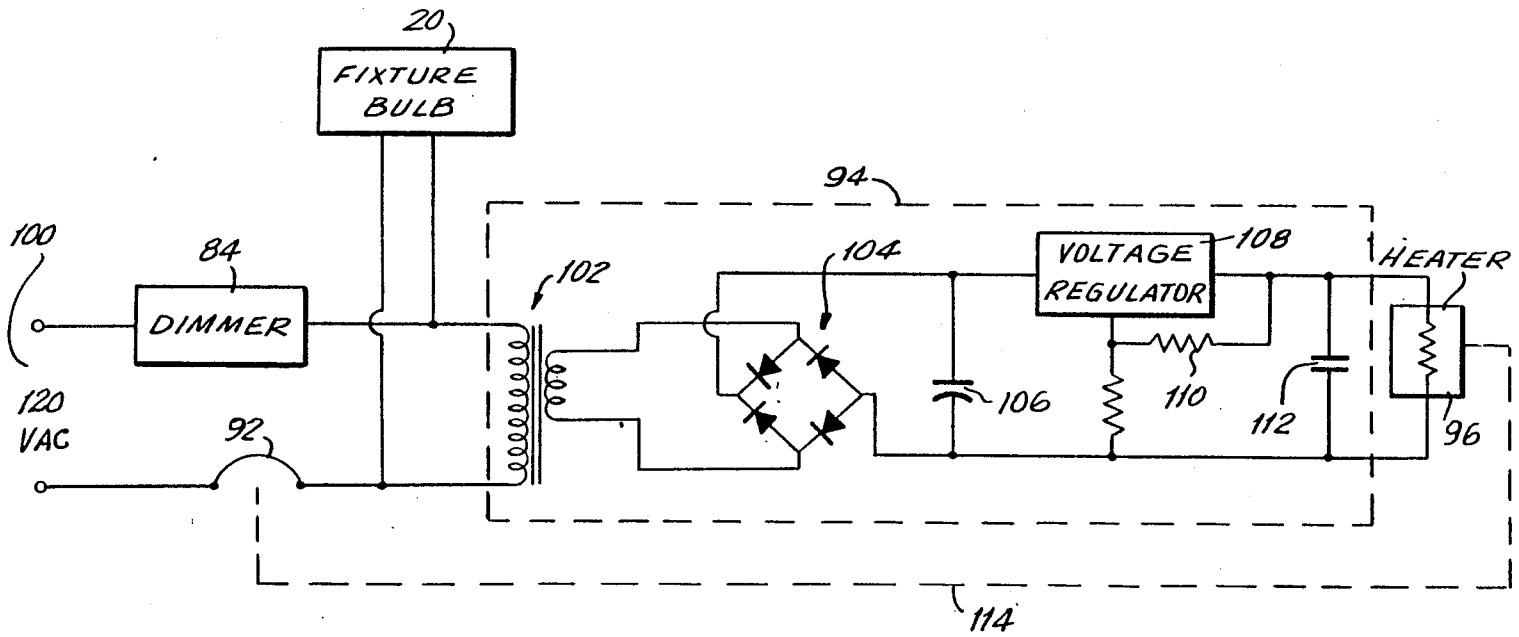
FIG. 4 is a detailed circuit diagram of an embodiment of the circuitry of the present invention.

FIG. 4 shows a detailed circuit diagram of an embodiment of the schematic shown at FIG. 3. The regulating circuit 94 is shown within the dotted line and includes a voltage stepdown device 102. Such device could be a transformer, a resistance divider, or a capacitive divider. The stepdown voltage at the output of the device 102 is fed into a full wave rectifying circuit 104. The output is filtered through a filter shown as capacitor 106. Voltage is then sent through a regulator 108 which can be either a voltage regulating integrated circuit or a zener diode. The DC voltage generated by the rectifying circuit 104 and passing through the voltage regulator 108 is adjusted for a proper voltage which is then applied across the thermal insulation sensor heater 96, shown as a resistor.

Upon operation of the dimmer 84, a reduced voltage will be applied to the fixture bulb 20. However, regardless of where the dimmer is set between its two predetermined ranges, the heater element 96 will always remain at a constant heat. This is as a result of the constant output voltage provided through the voltage regulator circuit 108. Appropriate resistors 110 and capacitors 112 are provided across the voltage regulator 108. The output from the heater 96 is thermally coupled to the temperature sensitive switch 92 as shown by the dotted lines 114.

It should be appreciated that alternate circuit arrangements could be utilized whereby the heater is maintained at a constant voltage through a voltage regulating circuit despite the presence of the dimmer circuit. By means of the present circuitry, the heat flow detector will protect the lighting fixture even when a dimmer is being utilized.

There has been disclosed heretofore the best embodiment of the invention presently contemplated. However, it is to be understood that various changes and modifications may be made thereto without departing from the spirit of the invention.

What is claimed is:

1. Apparatus for protecting against overheating of a lamp fixture energized from a dimmer controlled voltage source, comprising:

a heat flow detector for attachment at a location in the vicinity of the lamp fixture to be subject to the same heat flow environment conditions as the lamp fixture, and comprising a temperature sensitive switch electrically coupled to said lamp fixture disconnecting the lamp fixture from the dimmer controlled voltage source in response to a predetermined temperature, a biasing heater energized from said dimmer controlled voltage source and thermally coupled to the temperature sensitive switch for raising the temperature of the switch to said predetermined temperature when overheating of the lamp fixture prevents adequate dissipation into the environment of the heat from the biasing heater, and a regulator circuit for maintaining a required voltage across said biasing heater even upon reduction of the energization voltage from said dimmer controlled voltage source.

2. Apparatus as in claim 1, wherein said regulator circuit comprises a stepdown device for coupling across said lamp fixture, a rectifying circuit coupled across the output of the stepdown device, and a voltage regulator coupled to the output of the rectifying circuit.

3. Apparatus as in claim 2, wherein said rectifying circuit is a full wave rectifier, and further comprising a filter for filtering the output of the rectifier.

4. Apparatus as in claim 2, wherein said voltage regulator comprises a voltage regulating integrated circuit.

5. Apparatus as in claim 2, wherein said voltage regulator comprises a zener diode arrangement.

6. Apparatus as in claim 2, wherein said stepdown device comprises a transformer.

7. Apparatus as in claim 2, wherein said stepdown device comprises a resistive divider.

8. Apparatus as in claim 2, wherein said stepdown device comprises a capacitive device.

9. Apparatus as in claim 1, wherein said biasing heater is a resistive device.

10. Apparatus as in claim 1, and further comprising control means associated with said temperature sensitive switch for setting the temperature at which the switch responds.

11. Apparatus as in claim 1, and comprising a junction box for mounting adjacent the lamp fixture and supporting such flow detector.

12. A heat flow detector for use with a dimmer controlled lighting fixture, comprising a temperature sensitive switch electrically connected to the lighting fixture to disconnect the fixture upon detecting of a predetermined temperature, a source of heat thermally coupled to the switch for generating a temperature above the temperature of the environment, wherein the temperature of the environment is subject to the heated condition of the lighting fixture, the source of heat being sufficient to operate the switch when the lighting fixture is overheated, and a voltage regulating control circuit electrically coupled in parallel across the lighting fixture, receiving as an input the reduced voltage applied to the fixture by operation of the dimmer and maintaining as an output a constant voltage required for adequate operation of said source of heat.

13. A heat flow detector as in claim 12, and comprising a stepdown voltage device connected in parallel across the fixture, a full wave rectifier connected across the output of the stepdown voltage device, and filter means for filtering the output of the rectifier, the voltage regulating circuit being coupled to said source of heat.

14. A heat flow detector as in claim 13, wherein said source of heat is a resistive element.

15. A heat flow detector as in claim 13, wherein said stepdown voltage device comprises a transformer.

16. A heat flow detector as in claim 12, wherein said voltage regulating circuit comprises a zener diode arrangement.

* * * * *